US005979313A

United States Patent [19]

Fromm

[11] Patent Number: 5,979,313

[45] Date of Patent: Nov. 9, 1999

[54] STENCIL HOLDER HAVING INDEPENDENTLY MOVABLE TENSIONING ELEMENTS

[75] Inventor: Alfred Fromm, Reutlingen, Germany

[73] Assignee: bebro-electronic Bengel & Bross GmbH, Frickenhausen, Germany

[21] Appl. No.: 09/108,988

[22] Filed: Jul. 1, 1998

[51] Int. Cl.[6] ..... B41F 15/36

[52] U.S. Cl. ..... 101/127.1; 101/415.1

[58] Field of Search ..... 101/127.1, 128.1, 101/415.1

[56] References Cited

U.S. PATENT DOCUMENTS

| | | | |
|---|---|---|---|
| 2,565,218 | 8/1951 | Freeborn | 101/127.1 |
| 3,414,994 | 12/1968 | Jaccard et al. | 101/127.1 |
| 3,469,695 | 9/1969 | Greeninger | 101/415.1 |
| 3,788,216 | 1/1974 | Lambert | 101/127.1 |
| 4,442,772 | 4/1984 | Bubley | 101/127.1 |
| 5,235,908 | 8/1993 | Froelicher et al. | 101/127.1 |

FOREIGN PATENT DOCUMENTS

| | | | |
|---|---|---|---|
| 60-79953 | 5/1985 | Japan | 101/127.1 |
| 280446 | 1/1952 | Switzerland . | |
| 2294905 | 5/1996 | United Kingdom . | |

*Primary Examiner*—Edgar Burr
*Assistant Examiner*—Leslie J. Grohusky
*Attorney, Agent, or Firm*—Barry R. Lipsitz; Ralph F. Hoppin

[57] ABSTRACT

In order to improve a stencil holder for stencils, preferably for screen printing, comprising a frame having four frame supports, at least two rows of tensioning elements acting on corresponding rows of fixing points of the stencil, these rows being arranged on the frame and located opposite one another and at least one of these rows being movable in a first tensioning direction extending transversely to the rows for tensioning the stencil, such that this is constructed in as simple a manner as possible and allows as optimum a tensioning of the stencil as possible it is suggested that the tensioning elements of the movable row be guided for movement in the direction of the tensioning direction by a plurality of guide elements, that with each guide element at least one tensioning element associated therewith be movable independently of the respectively other tensioning elements, that the guide elements for each row of tensioning elements be arranged on a guide rail extending along the respective row and that the guide elements of the row of tensioning elements be acted upon by at least one source of tension force.

34 Claims, 5 Drawing Sheets

STENCIL HOLDER HAVING INDEPENDENTLY MOVABLE TENSIONING ELEMENTS

BACKGROUND OF THE INVENTION

The invention relates to a stencil holder for stencils, preferably for screen printing, comprising a frame having four frame supports, at least two rows of tensioning elements acting on corresponding rows of fixing points of the stencil, these rows being arranged on the frame and located opposite one another and at least one of these rows being movable in a first tensioning direction extending transversely to the rows for tensioning the stencil.

A stencil holder of this type is known, for example, from WO 96/14210.

In contrast to the stencil holders previously known, a stencil holder of this type already allows a considerably simplified and improved tensioning of the stencil.

SUMMARY OF THE INVENTION

The object underlying the invention is to further improve a stencil holder of the generic type such that this is constructed in as simple a manner as possible and allows as optimum a tensioning of the stencil as possible.

This object is accomplished in accordance with the invention, in a stencil holder of the type described at the outset, in that the tensioning elements of the movable row are guided in the direction of the tensioning direction by a plurality of guide means, that with each guide means at least one tensioning element associated therewith can be moved independently of the respectively other tensioning elements, that the guide means for each row of tensioning elements are arranged on a guide rail extending along the respective row and that the guide means of the row of tensioning elements can be acted upon by at least one source of tension force.

The advantage of the inventive solution is to be seen in the fact that as a result of the plurality of guide means movable independently of one another the possibility is created of compensating for the different expansions of the stencil during tensioning and thus allow, in the end, an even better tensioning of the stencils.

With respect to the association of the tensioning elements with the guide means, the most varied of possibilities are conceivable. For example, it would be conceivable to associate two tensioning elements with each guide means. It is, however, particularly advantageous when a separate guide means is provided for each tensioning element so that a plurality of tensioning elements with corresponding guide means has then simply to be arranged on the guide rail.

With respect to the design of the individual guide means, the most varied of possibilities are conceivable. A particularly advantageous solution provides for the guide means to guide the tensioning element for movement exclusively in a tension force direction. In this respect, the tensioning direction need not necessarily coincide with the tension force direction since the tension force direction has in any case a component in tensioning direction but can have a transverse component in a direction at right angles to the plane of support of the stencil, as will be explained in detail in the following.

From a constructional point of view, the guide means may be designed in a particularly simple manner in that this has a guide member which is guided in a guide member receiving means for movement in the tension force direction.

In order to be able to realize the large number of guide means in the guide rail, it is preferably provided for the guide member receiving means to be arranged in the guide rail, for example, in the case of channels or bores extending in the tension force direction, in which the respective guide member is movable.

With respect to the interaction between guide member and tensioning element, no further details have so far been given. A particularly advantageous solution from a constructional point of view provides for the guide members to directly support the tensioning elements, i.e. no additional, intermediate elements are required.

With respect to the mounting of the guide members themselves, no further details have been given in conjunction with the preceding embodiments. A particularly advantageous embodiment which avoids, in particular, any jamming or canting of the guide member provides, for example, for each guide member to be guided in the direction of the tension force direction on both sides of the tensioning element arranged thereon.

With respect to the source of tension force to be provided, no further details have been given in conjunction with the preceding explanations concerning the individual embodiments. One advantageous embodiment provides, for example, for the tensioning elements associated with several guide means to be acted upon with a single source of tension force.

Alternatively thereto, it is, however, also possible for a separate source of tension force to be associated with each guide means. This allows the independent movability of the guide means relative to one another to be realized in a particularly simple manner, wherein a compact mode of construction is already possible on account of the large number of sources of tension force associated with the guide means. A particularly compact mode of construction is possible when the number of sources of tension force corresponds to the number of tensioning elements since, in this case, a source of tension force is preferably associated with each tensioning element and the sources of tension force can thus be of a very compact design since they need only generate the force which acts on the stencil from one tensioning element.

Apart from the association of the sources of tension force with the guide means or the tensioning elements, the type of sources of tension force has not so far been specified in greater detail. One advantageous embodiment provides, for example, for the source of tension force to have a pressure element variable in volume by means of a medium subject to pressure. In this case, the necessary tension force can then be generated by the medium being acted upon with the pressure, wherein sources of tension force of this type have the advantage that they are, on the one hand, of a compact construction and, on the other hand, can be acted upon with the medium subject to pressure in a simple manner from the outside, for example, via a pressure line and thus are particularly well suited for a compactly constructed stencil holder.

One possibility of realizing a pressure element of this type is for the variable-volume pressure element to have a container consisting of a flexible material for the medium subject to pressure. In this case, the container consisting of flexible material may be a container consisting of an elastic flexible material or simply a bendingly slack, flexible material.

In the case where all the tensioning elements of one guide rail can be acted upon by a single source of tension force, each of the guide means is movable in tensioning direction independently of the other guide means in tensioning direction although only one single source of tension force is provided for this. The possibility is thus created, despite this single source of tension force, of compensating for different expansions of the stencil in the respective tensioning direction.

In this case, it is expediently provided for the source of tension force to extend along the respective row of tensioning elements and, with it, different tensioning distances to be generated in different sections in longitudinal direction, wherein this may be realized by the container consisting of a flexible material and thus this flexible material being deformable to varying degrees in tension force direction in the respective section of the source of tension force.

In the simplest case, it is provided for the volume-variable pressure element to be a pressure hose.

A single source of tension force extending along the guide rail for all the guide means thereof could be arranged, for example, in a receiving means extending next to the guide rail and or be supported on a support arranged next to the guide rail.

A particularly favorable constructional solution provides for the source of tension force to be located in a receiving means extending along the guide rail, and thus a particularly compact mode of construction is possible.

The receiving means can preferably be covered with a cover element for securing the source of tension force and for improving the action of the force.

Alternatively to providing a container consisting of a flexible material for the material subject to pressure, a particularly preferred solution provides for the tensioning elements of the movable row to be movable in the tensioning direction by a plurality of cocking cylinders, for at least one tensioning element associated with a cocking cylinder to be movable with each cocking cylinder independently of the respectively other tensioning elements, for each cocking cylinder to have a cocking piston mounted for displacement in a cylinder chamber and for the cylinder chambers for the cocking cylinders of each row of tensioning elements to be arranged in the guide rail extending along the respective row. This solution has the great advantage that as a result of the plurality of cocking cylinders the possibility is created of designing these in as small and space-saving a manner as possible and thus arranging all the cocking cylinders in a row in the guide rail which extends in the longitudinal direction of the row. Furthermore, this solution has the advantage of simple producibility and a small constructional space.

In this respect, all the cocking cylinders for a row of tensioning elements are preferably designed such that each tensioning element acts with the same force on the fixing point associated therewith so that the stencil is tensioned in tensioning direction uniformly with the same respective force despite possible, varying expansions in all regions seen transversely to the tensioning direction.

With respect to the design and arrangement of the cylinder chambers no further details have so far been given. A particularly favorable solution provides, for example, for the cylinder chambers to be arranged in the guide rail with cylinder chamber axes aligned parallel to one another. Thus, all the cocking cylinders of one guide rail operate in the same direction.

In order to be able to supply the cocking cylinders of a row of tensioning elements as simply as possible with medium subject to pressure, it is preferably provided for the cylinder chambers of a row of tensioning elements to be supplied with the medium subject to pressure by a common supply channel.

This creates the possibility, despite the great number of cocking cylinders, of supplying these as simply as possible and parallel to one another and, in addition, of ensuring that the tensioning elements always act with the same force on the entire row of fixing points.

The cylinder chambers may, in principle, be of any optional design. It is particularly advantageous when the cylinder chambers are designed as cylinder chamber bores in the guide rail. This provides a particularly simple possibility of producing cylinder chambers of this type in the guide rail.

In this respect, the cylinder chambers are preferably designed as cylinder chamber bores with the same cross section.

With respect to the interaction of the cocking pistons, the cocking cylinders and the tensioning elements no further details have so far been given. It would, for example, be conceivable for the cocking cylinders to act indirectly on the tensioning elements, for example, by means of an intermediate support for the tensioning elements. A particularly advantageous solution which is particularly favorable with respect to its simplicity provides for the cocking pistons to directly support the tensioning elements. This solution may be realized in a particularly simple manner when the tensioning elements project from the cocking pistons and the cocking pistons form at the same time the guide means for the tensioning elements within the meaning of the present invention.

In this respect, it is particularly favorable when the cocking pistons are guided on both sides of the tensioning elements in the direction of the cylinder chamber axis so that a guidance of the cocking pistons which is as free from canting as possible represents at the same time an exact guidance of the tensioning elements.

In this respect, a solution is particularly expedient, in which the cocking pistons support the tensioning elements in a region central in the direction of the cylinder chamber axis so that an adequate guidance for the cocking pistons and the tensioning elements is still available on both sides.

Furthermore, it is favorable when the cocking pistons are essentially guided over their entire length in the corresponding cylinder chambers.

An additional, alternative possibility for generating the tension force by means of the source of tension force provides for the source of tension force to comprise an elastic biasing means, for example, a spring which serves to apply the desired tension force.

This elastic biasing means can serve alone to apply the tension force, it can, however, also be provided in addition to a medium subject to pressure.

In conjunction with the embodiments described thus far, no details have been given as to how a release of the tension force is intended to be brought about, particularly in order to change the stencil. In the case of a medium subject to pressure, it is conceivable in the simplest case to provide a release of pressure and thus cause the force issuing from the medium subject to pressure to fall.

This is not, however, possible in the case of an elastic biasing means, for example.

For this reason, one advantageous solution provides for a tension release element to be provided, with which the tensioning elements are movable contrary to the action of the sources of tension force into a position freeing the stencil. In this respect, the source of tension force can also comprise a medium subject to pressure which is then, however, counteracted by the tension release element with its tension release force.

In this case, the tension release element does, however, counteract the tension force of any type of source of tension force and so it would not be necessary, for example, to provide any discharging on the part of the source of tension force.

In the simplest case, the tension release element may be designed such that this is an element variable in volume by means of a medium subject to pressure, for example, preferably consisting of a flexible material, wherein the realization possibilities are the same as those described for the pressure element.

With respect to the design of the tensioning elements and the fixing points, no further details have been given in conjunction with the preceding explanations. It would be conceivable, for example, to provide a local clamping point as fixing point, and a clamp gripping the stencil locally at the clamping point as tensioning element. This solution is, however, complicated, on the one hand, and has the disadvantage, on the other hand, that it benefits an uneven traction and thus the formation of folds, for example.

For this reason, it is preferably provided for each tensioning element to be an entraining means which engages in a fixing point designed as a recess in the stencil.

In the simplest case, the tensioning element is designed as a bolt or pin which engages in an opening in the stencil. This solution has the advantage that it is simple to produce, on the one hand, and, on the other hand, still offers the possibility of provided many tensioning elements arranged locally next to one another which are simple to produce.

In this respect, it is particularly favorable, particularly in order to position the stencil exactly relative to the frame, when the tensioning elements and the fixing points form a fit with one another, i.e., not only the respective tensioning element but also the respective fixing point form fitting surfaces interacting with one another in order to attain an exact positioning of the stencil relative to the frame.

Particularly when a row of tensioning elements is arranged rigidly on the corresponding frame support, an exact and defined positioning of the stencil relative to the stencil holder is then possible.

In conjunction with the preceding description of the individual embodiments, no details have been given as to how the guide rail is to be arranged relative to the frame supports. It would, for example, be possible within the scope of the inventive solution to arrange the guide rail next to the respective frame support and thus fix it in position on the frame support.

It is, however, particularly favorable when the guide rail forms the frame support arranged on the corresponding side of the frame, i.e., that an additional frame support can be omitted and the guide rail directly represents this frame support.

This means that the frame can be of an extremely compact construction, in particular, in lateral direction or as large a stencil as possible can be inserted with a predetermined frame size and so the usable area of the stencil is larger than in the solutions previously known. As for the rest, it is likewise unnecessary, in comparison with the solutions previously known, to provide frame supports in addition.

In order to be able to position the stencil in as defined a manner as possible on the frame, it is preferably provided for an abutment surface to be arranged on the frame, on which the stencil can be placed with its respective edge strips. Thus, a defined level of the stencil is provided in a simple manner.

It is particularly favorable when the tensioning elements act on the fixing point with a tension force which draws the stencil against the abutment surface, in particular, with its edge strip.

This may be realized in a particularly simple manner when the tension force acts in a tension force direction which forms an acute angle with a stencil plane.

Such a force effect could be achievable in the most varied of ways. It is particularly favorable, in particular, in order to generate the tension force as efficiently as possible when the tensioning elements are movable in a direction which forms an acute angle with the stencil plane. Thus, the force which serves to move the tensioning elements is directed in the same direction as the tension force and so as simple a conversion as possible of the force for the movement of the tensioning elements into the tension force results.

In the simplest case, the guide means are all arranged such that their directions of movement likewise form with the stencil plane the acute angle, at which the tensioning elements are movable.

In conjunction with the preceding description of several embodiments, it has merely been assumed that one row of tensioning elements is movable relative to the other in the tensioning direction, wherein this requires at least the movability of one row in the first tension force direction.

Alternatively thereto, this solution can, however, also be realized by both rows of tensioning elements being movable away from one another in the first tensioning direction for the purpose of tensioning.

A particularly advantageous solution of an inventive stencil holder provides for this to have in a second tensioning direction which extends transversely to the first tensioning direction two rows of tensioning elements which are located opposite one another and with which the stencil is also movable in a second tensioning direction.

This solution is particularly favorable when not only one row but both rows of tensioning elements are movable in the second tensioning direction guided by guide means so that a tensioning movement can be realized in a simple manner without the positioning of the stencil being affected, for example, by a row of stationary tensioning elements.

A particularly advantageous solution provides for the tension force in the second tensioning direction to be essentially equal to the tension force in the first tensioning direction so that the stencil is tensioned with essentially the same force not only in the first but also in the second direction.

This may be realized particularly favorably when the sources of tension force effective in the second tensioning direction are acted upon with the same actuating medium subject to pressure as the sources of tension force effective in the first tensioning direction.

In the simplest case, all the cocking cylinders of all the rows of tensioning elements are acted upon with an actuating medium which comes from one source and so all the sources of tension force are acted upon with the same pressure.

Additional features and advantages of the inventive solution are the subject matter of the following description as well as the drawings illustrating several embodiments.

DETAILED DESCRIPTION OF THE INVENTION

Figure 1:
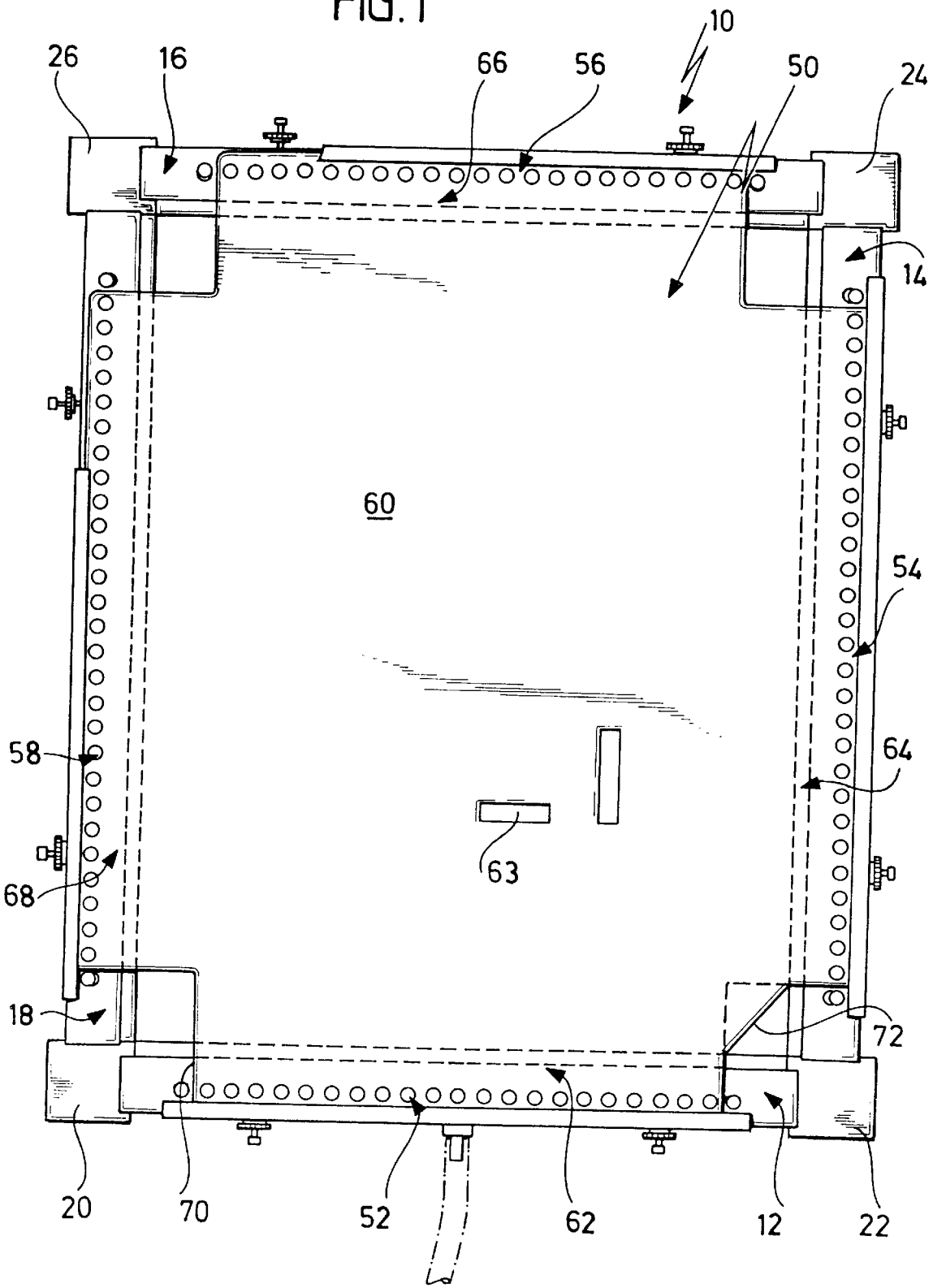
FIG. 1 shows a plan view of an inventive stencil holder with a stencil placed thereon.

A first embodiment of an inventive stencil holder, illustrated in FIG. 1, comprises a frame which is designated as a whole as 10 and is formed from four frame supports 12, 14, 16 and 18 which altogether form a square and are connected to one another by corner pieces 20, 22, 24, 26.

Figure 4:
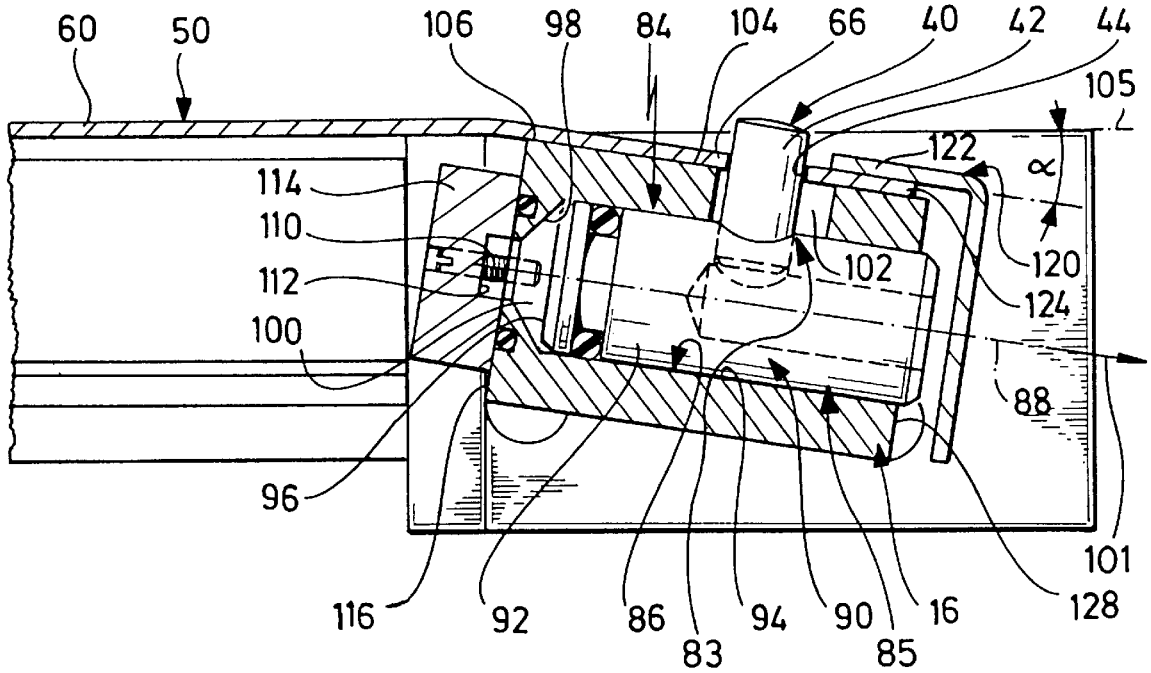
FIG. 4 shows a section along line 4—4 in FIG. 3.

Each of these frame supports 12 to 18 supports a respective row 32, 34, 36, 38 of tensioning elements 40 which are all designed identically to one another, preferably, as illustrated in FIG. 4, in the form of a bolt 40 with a cylindrical outer wall 42 which engages in a likewise cylindrical recess 44 forming a fixing point of a stencil 50, thereby forming a fit. The recesses 44 thereby form corresponding rows 52, 54, 56, 58 of fixing points of the stencil 50 which extend along a respective edge strip 62, 64, 66, 68 of the stencil 50, wherein the respective edge strip 62, 64, 66, 68 adjoins a stencil field 60, in which recesses 63 serving for screen printing are provided.

The stencil 50 is preferably designed as a metal film, in particular, a fine steel film and likewise has non-reinforced edge strips 62, 64, 66, 68 which are integrally formed on the stencil field 60 and designed in the form of the film and are provided with the fixing points 44. Furthermore, the edge strips 62, 64, 66, 68 are preferably not connected directly with one another but merely via the stencil field 60 in order to avoid any formation of folds in the region of the corners. The corners of the stencil 50 are therefore provided either in regions of touching edge strips with right-angled notches 70 or with a bevel 72 which extends from edge strip to edge strip and is illustrated in FIG. 1 in the region of the corner piece 22 instead of a notch indicated by a dashed line.

In the inventive frame 10, the row 32 is formed by tensioning elements 40 anchored stationarily in the frame support 12. These are, in the simplest case, pins rigidly anchored in the frame support 12.

The row 32 of tensioning elements 40 and the row 36 of tensioning elements 40 located opposite it serve to tension the stencil 50 in a first tensioning direction 80 while the row 34 of tensioning elements 40 and the row 38 of tensioning elements 40 located opposite it serve to tension the stencil 50 in the direction of a second tensioning direction 82 which extends transversely, preferably at right angles, to the first tensioning direction 80.

Figure 3:
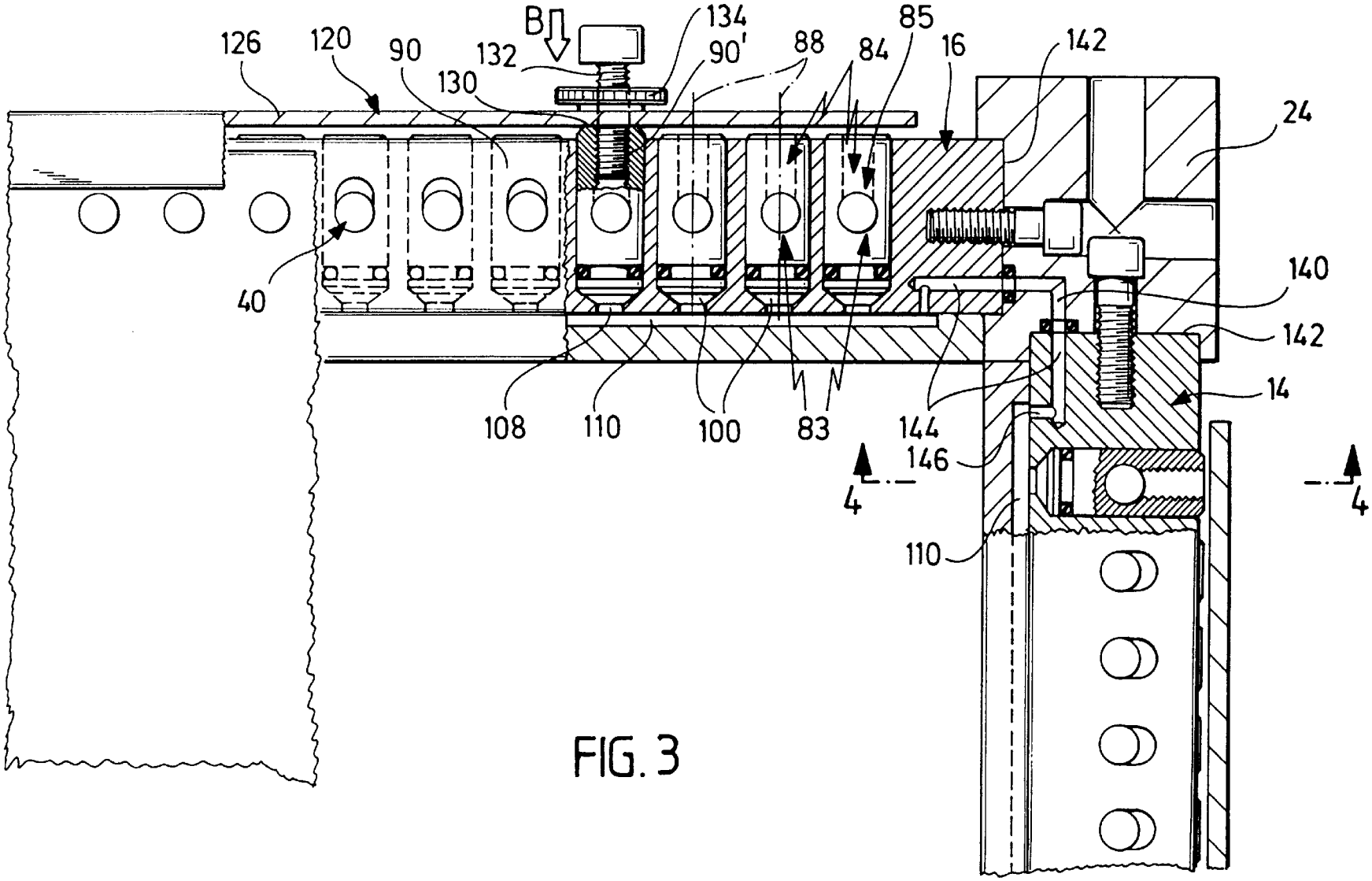
FIG. 3 shows an enlarged illustration of the area A in FIG. 2.

For the purpose of tensioning in the first tensioning direction 80 all the tensioning elements 40 of the row 36 are guided for movement by a plurality of identical guide means 83 and, for the purpose of tensioning the stencil 50, acted upon by a plurality of identical sources 84 of tension force, wherein in the case illustrated in the drawings a separate guide means 83 and a separate source 84 of tension force is associated with each of the tensioning elements 40. The guide means 83 and the source 84 of tension force are formed by a cocking cylinder 85, wherein, as illustrated in FIGS. 3 and 4, each cocking cylinder 85 has a guide member and cocking piston 90 movable in a guide member receiving means and cylinder chamber 86 in the direction of a cylinder chamber axis 88 and mounted in the cylinder chamber 86. Each cocking piston 90 comprises an outer casing surface 92 which extends over a guide length in the direction of the cocking piston axis 80 and is preferably designed as a cylinder surface of a circular cylinder. With this casing surface 92 the cocking piston 90 is guided for displacement in the direction of the cylinder chamber axis 80 in a corresponding inner cylinder surface 94 of the cylinder chamber 86.

Each cocking cylinder 85 preferably supports the respective tensioning element 40 such that this is arranged in a central region of the casing surface 92 when seen in the direction of the cylinder chamber axis 88 so that a guidance for the cocking piston 90 and thus also for the tensioning element 40 results on both sides of the tensioning element in the cylinder chamber 86.

The cocking piston 90 is, furthermore, provided with a piston base 96 which limits a pressure chamber 100 of the respective cocking cylinder 85 together with an end wall 98 of the cylinder chamber 86 and, where applicable, sections of the inner cylinder surface 94. A build-up of pressure in the respective pressure chamber 100 results in the cocking piston 90 being moved away from the end wall 98 and thereby moving the tensioning element 40 supported by it in this tension force direction 101. The tensioning element 40 thereby engages through a recess 102 which is approximately oval in design, adjoins the cylinder chamber 86 laterally, extends from the cylinder chamber 86 as far as a contact surface 104 for the corresponding edge strip 66 of the stencil 50 and has in the direction of the cylinder chamber axis 88 a length which defines and at the same time limits a maximum lift of the tensioning element 40.

The tensioning element 40 thereby projects beyond the contact surface 104 so that when the edge strip 66 is placed on the contact surface 104 the tensioning element 40 can engage through the fixing point 44 in the corresponding edge strip 66 which is designed as an opening.

The contact surface 104 is preferably inclined through an angle $\alpha$ in relation to a plane 105, parallel to which the stencil 50 extends with the stencil field 60, so that the corresponding edge strip 66 of the stencil 50 is likewise inclined through the angle $\alpha$ in relation to the plane 105, but extends as far as the plane 105 which defines a plane of support 105 for the stencil 50 and forms with an end region 106 facing the stencil field 60 an abutment surface, with which the height of the plane of support 105 is defined.

The stencil 50 is thus drawn over the abutment surface 106 in the region between the stencil field 60 and the respective edge strip 66 and, due to the fact that the edge strip 66 extends at the angle $\alpha$ in relation to the plane of support 105, is drawn against the abutment surface 106 so that the stencil field 60 can be positioned in a stable manner at the level of the contact plane 105.

In order for the respective edge strip 66 of the stencil 50 to remain on the contact surface 104 even during tensioning of the stencil 50, the cocking cylinders 84 are designed such that the cocking piston 90 moving parallel to the cylinder chamber axis 88 is moved in a tension force direction which extends parallel to the contact surface 104, and is thus likewise inclined through an angle $\alpha$ in relation to the plane of support 105.

The cylinder chambers 86 of a row of tensioning elements 40 are, as illustrated, in particular, in FIG. 3, likewise arranged in a row, namely directly in the corresponding frame support 16, wherein their cylinder chamber axes 88 extend parallel to one another and parallel to the contact surface 104.

Furthermore, all the pressure chambers 100 of the cocking cylinders 85 of the row 36 of tensioning elements 40 are located on a side facing the stencil field 60 and are connected by connection channels 108 to a common pressure channel 110 which supplies the cocking cylinders 85 of a respective row of tensioning elements 40 in the respective frame support 16.

The common pressure channel 110 extends, as illustrated, in particular, in FIG. 4, in the form of a groove 112 in a pressure channel bar 114 which is preferably placed on a side 116 of the respective frame support 16 facing the stencil field 60 and laterally sealed. This results in the possibility of designing the connection channels 108 as simple bores which penetrate the end wall 98 of the respective cylinder chamber 86 and have an opening on the side 116 of the corresponding frame support 16 facing the stencil field 60, wherein the groove 112 overlaps all the openings of all the connection channels 108 of all the cocking cylinders 85 in the respective frame support 16.

When the pressure channel 110 of the respective frame support 16 is acted upon, all the pressure chambers 100 of the cocking cylinder 85 associated with this frame support 16 are acted upon with the same pressure so that each of the cocking cylinders 85 with the tensioning element 40 associated with it acts on the fixing point 44 associated therewith in the respective edge strip 66 with the same tension force and thus, altogether, each individual one of the tensioning elements 40 acts on the respective fixing point 44 with the same tension force along the entire length of the edge strip 66.

The inventive solution with the plurality of individual cocking cylinders 85 has the great advantage that even when seen in longitudinal direction of the respective row of tensioning elements 40 different expansions of the stencil 50, particularly of the stencil field 60, are compensated in the direction of the respective tensioning direction 80 since, in this case, the cocking pistons 90 of those cocking cylinders 85, which are located in a region of greater expansion in the tensioning direction 80, move through a greater distance in the tensioning direction 80 than the remaining ones and so a completely uniform tensioning of the stencil 50 may thus be achieved transversely to the respective tensioning direction 80.

In order to prevent the respective edge strip 66 lifting away from the contact surface 104 prior to tensioning or during tensioning, a holding-down device designated as a whole as 120 is provided and this has a holding-down bar 122 which serves to keep an outer region 124 of the respective edge strip 66, which abuts on the contact surface 104 on a side of the tensioning elements 40 facing away from the abutment surface 106, in contact with this contact surface, wherein the holding-down bar abuts on a side of the outer region 124 facing away from the contact surface 104.

The outer region 124 of the edge strip 66 is still displaceable on the contact surface 104 in order to allow the tensioning movement of the edge strip 66 during the tensioning of the stencil 50.

In principle, the holding-down device 120 could be arranged so as to be immovably fixed on the respective frame support 16. Particularly favorable, however, is an entrained fixing of the holding-down device 120, wherein the holding-down device 120 has for this purpose a holding bar 126 which extends transversely to the holding-down bar 122 over a side 128 of the respective frame support 16 facing away from the side 116 and is thereby connected to two of the pistons 90 arranged in the respective frame support 16, for example, via a screw connection illustrated in FIG. 3, wherein in this case the pistons 90' supporting the holding bar 126 are of an extended design in the direction of the cylinder chamber axis 18 in comparison with the remaining pistons 90 and have an end face 130 which serves as a contact surface for the holding bar 126.

Figure 5:
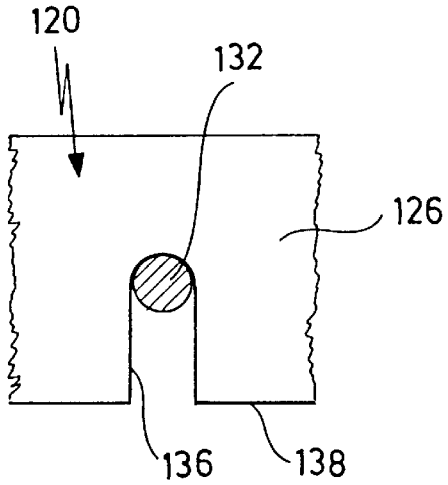
FIG. 5 shows a view of a detail in the direction of arrow B in FIG. 3 which merely shows a section of a holding-down device.

In the simplest case of a connection, a threaded pin 132, onto which a setscrew 134 is screwed, projects out of this end side 130, wherein the holding bar 126 can be clamped between the setscrew 134 and the end side 130. In order to make a simple insertion of the holding bar 126 possible, this is, as illustrated in FIG. 5, provided with recesses 136 of an inverted U-shape which are open towards a lower edge 138 of the holding bar 126 located opposite the holding-down bar 122 and thus make an insertion of the holding bar 126 possible while engaging around the threaded pin 132 in such a manner that the holding-down bar 132 is moved in the direction towards the outer region 124 of the corresponding edge strip 66.

If the stencil holder comprises not just one row of tensioning elements 40 which are movable in the corresponding tensioning direction 80 but additional rows 34 and 38 of tensioning elements 40 which are movable in an additional tensioning direction 82, the corner pieces 20 to 26 are preferably designed such that they have a connection channel 140 between the two pressure channels 110 bordering thereon.

The connection channel 140 opens into a respective end side 142 of the corresponding frame support 14 and 16, respectively, and then merges within the respective frame support 14 or 16 into a deflection channel 144 which connects the connection channel 140 again to the respective pressure channel 110, wherein the deflection channel 144 likewise preferably has an opening 146 which is overlapped by the groove 112 forming the pressure channel 110.

The pressure channels 110 of several frame supports 14, 16 and 18 can be connected with one another by connection channels 140 of this type so that a single pressure connection is sufficient to supply the pressure channels 110 and thus the pressure chambers 100 in all these frame supports 14, 16 and 18 with a medium subject to pressure.

Figure 2:
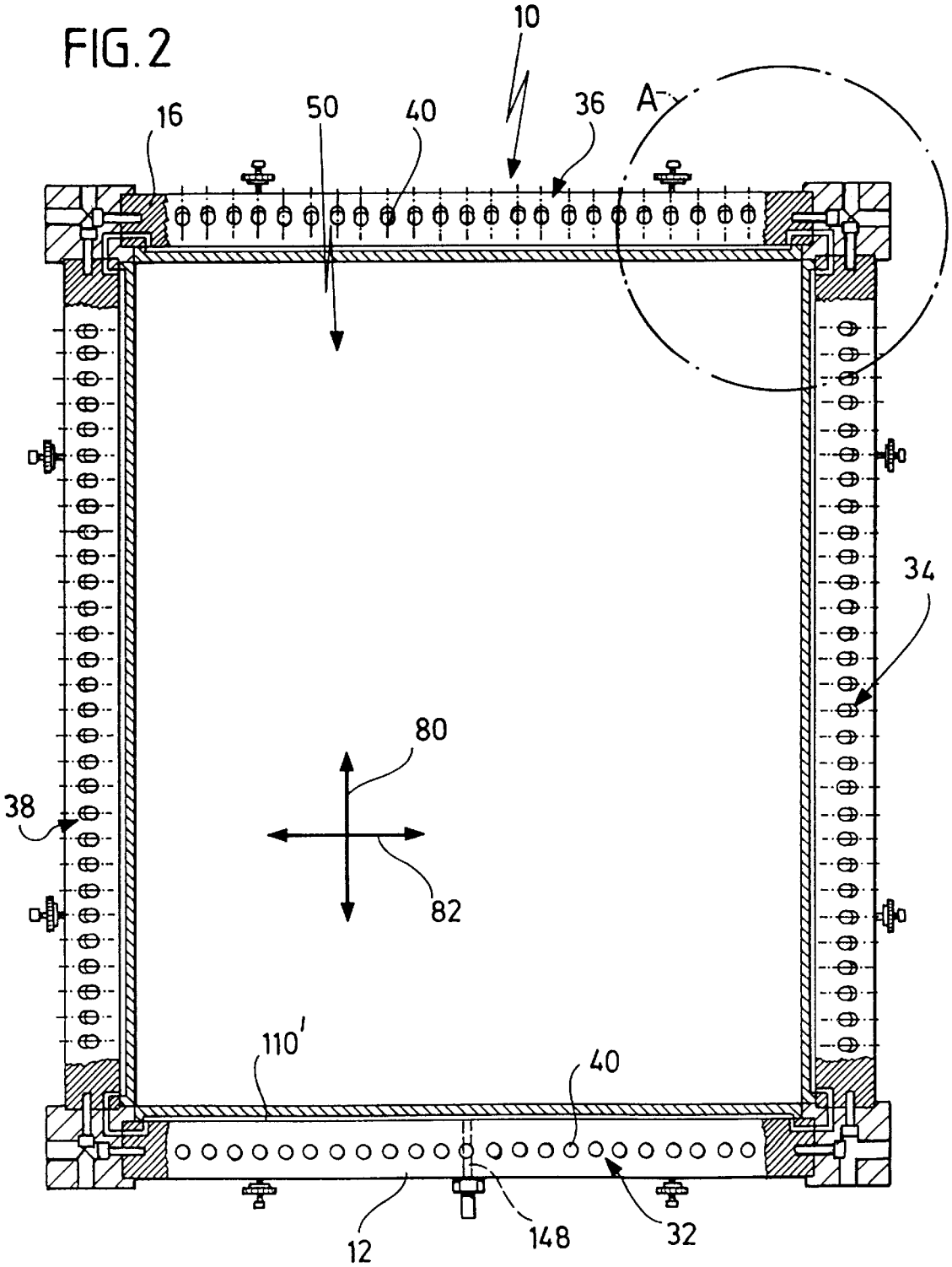
FIG. 2 shows a partially cutaway plan view of the inventive stencil holder without any stencil placed thereon.

In a particularly preferred variation of the first embodiment of the inventive stencil holder, the frame support 12 is, as illustrated in FIG. 2 and although it has no cocking cylinders 85, provided with a pressure channel 110' which merely serves to connect the pressure channels 110 of the frame supports 14 and 18 and, moreover, to lead to a pressure connection 148 which may be integrated in a particular simple manner in the frame support 12 having no cocking cylinders. Compressed air, for example, can be delivered via the pressure connection 148 and this flows via the pressure channel 110' into the remaining pressure channels 110 and acts on all the pressure chambers 100 in the frame supports 14, 16 and 18 with the same pressure.

Figure 6:
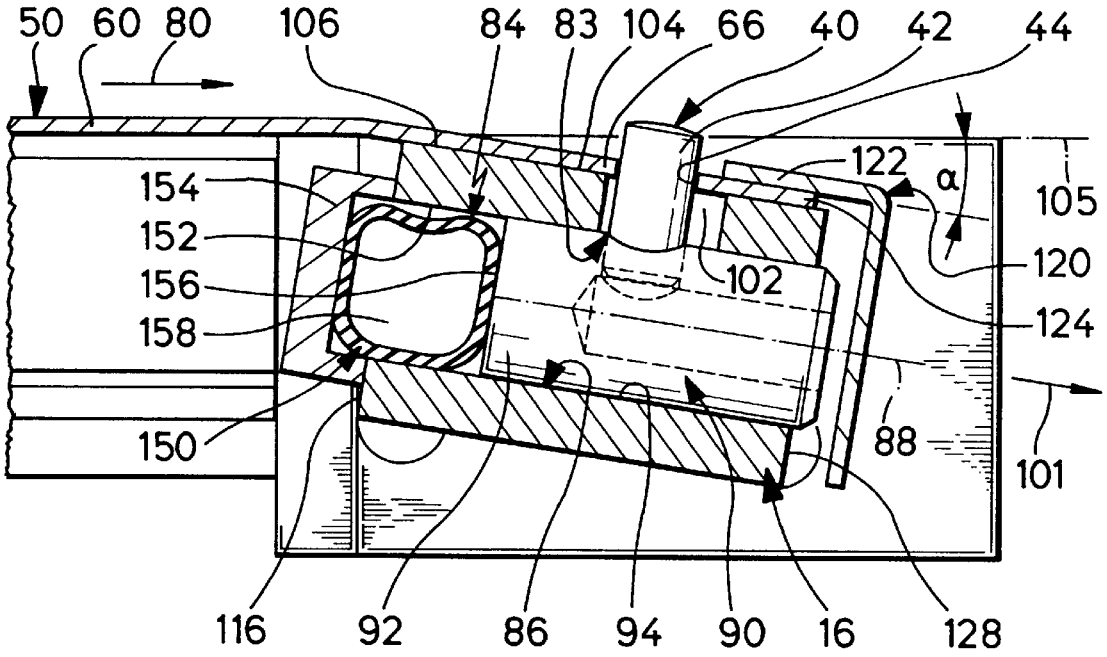
FIG. 6 shows a section similar to FIG. 4 through a second embodiment and FIG. 7 shows a section similar to FIG. 4 through a third embodiment.

In a second embodiment of an inventive stencil holder, illustrated in FIG. 6, those parts which are identical to those of the first embodiment have been given the same reference numerals and so, with respect to their description, reference can be made to the comments concerning the first embodiment.

In contrast to the first embodiment, the guide member 90 does not form the cocking piston at the same time but is limited to its guide function within the scope of the guide means 83.

Furthermore, the guide member receiving means also no longer forms any cylinder chambers but merely the guide member receiving means 86 for the guide member 90 with its inner cylinder surface 94.

In order to act on the guide member 90 of the respective row, a pressure hose 150 serves as source 84 of tension force and this extends along the respective frame support 12, 16, 18 provided with guide members 90 and is thereby located in a hose channel 152 which extends, on the one hand, as a recess along the frame support 16 on the side 116 facing the stencil field 60 and, on the other hand, is covered by a cover bar 154 which, for its part, abuts on the side 116, covering the hose channel 152, and is held on the respective frame support 16.

The pressure hose 150 therefore acts with respectively successive longitudinal sections on the individual guide members 90 of the respective row which are arranged one after the other, namely on an end side of the respective guide member 90 facing the hose channel 152, so that when the pressure hose is acted upon in its interior 158 with a medium subject to pressure the pressure hose 150 endeavors to expand in radial direction, wherein the expansion of the pressure hose 150 is limited by the hose channel 152, except for the locations, at which the pressure hose 150 abuts on the end sides 156 of the guide members 90.

It is thus possible to act on all the guide members 90 in the tensioning direction with a single source 84 of tension force, namely in the form of the pressure hose 150, wherein each individual guide member 90 still has the possibility of moving in the tension force direction 101 independently of the other guide members 90 when acted upon by means of the corresponding section of the pressure hose 150, namely according to how far a movement of the tensioning element 40 for tensioning the stencil 50 in the tensioning direction 80 is required in order to tension the stencil 50 uniformly.

Figure 7:
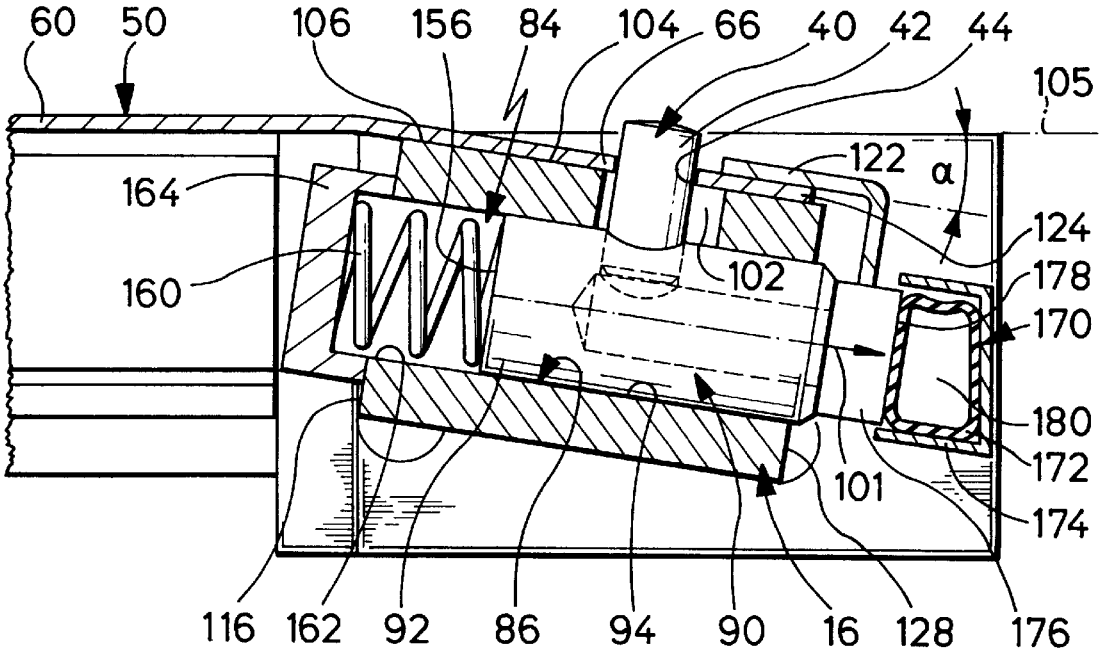

In a third embodiment, illustrated in FIG. 7, each of the guide members 90 likewise operates merely as such and not as a cocking piston and is guided in the corresponding guide member receiving means 86.

To tension the stencil 50, each of the guide members 90 is acted upon by a pressure spring 160 which acts as source 84 of tension force, acts on the end side 156 of the guide member 90 and is arranged in a section 162 of the inner cylinder surface 94 extending beyond the guide member 90 in the direction of the stencil 50. The pressure spring 160 is thereby supported on a cover bar 164 which extends along the entire frame support 16 on the side 116 thereof and engages over the individual guide member receiving means 86 open towards the side 116.

Each guide member 90 and with it the individual tensioning element 40 securely arranged thereon is therefore always acted upon by the pressure spring 160 in the tension force direction and so the stencil 50 is always held in the tensioned state.

In order to be able to exchange the stencil 50 it is necessary to move all the guide members 90 of one of the rows 34, 36 and 38 contrary to the tension force direction and contrary to the action of the pressure spring 160.

For this purpose, a tension release element 170 is provided, for example, in the form of a pressure hose 172 which is arranged in a U-shaped receiving means 174 which extends parallel to the respective frame support 16 on a side facing away from the stencil 50 and with its open side faces a rearward extension 176 of the guide member 90, wherein the rearward extension has a rearward end face 178 which faces the open side of the U-shaped receiving means 174 and is arranged to close this or engage in it so that the pressure hose 172 of the tension release element 170 is in a position to work against the rearward end side 178 and act on it.

If a medium subject to pressure is now supplied to an interior 180 of the pressure hose 172, this expands in radial direction and acts on the end side 178 of the guide member 90 and thus moves the entire guide member 90 contrary to the tension force direction and the action of the pressure spring 160 so that the tensioning elements 40 no longer act in a tensioning manner on the stencil 50 and thus the recesses 44 can be brought out of engagement with the bolts 40 in order to remove the stencil 50 and insert a new stencil.

As for the rest, the third embodiment is designed in the same way as the first embodiment and so those parts which are identical to those of the first embodiment are given identical reference numerals and with respect to their description reference can be made in full to the explanations concerning the first embodiment.

What is claimed is:

1. A stencil holder for stencils for screen printing, comprising:

a stencil made of metal film and having rows of fixing elements, a frame having four frame supports, at least two rows of tensioning elements acting on corresponding rows of said fixing elements by means of a positive connection with said fixing elements for removably fixing said stencil, said rows of tensioning elements being arranged on the frame and located opposite one another, said tensioning elements of at least one of said rows being movable in a first tensioning direction extending transversely to the rows for tensioning the stencil, a plurality of guide means for guiding said tensioning elements of the movable row for movement in the first tensioning direction, said guide means being arranged on said frame, at least one tensioning element being associated with each guide means and being movable independently of the respectively other tensioning elements, a guide rail arranged on said frame and extending along the respective row of tensioning elements, said guide means for each row of tensioning elements being arranged on said guide rail, and at least one source of tension force acting upon all tensioning elements of said one row of moveable tensioning elements with essentially the same tensioning force during screen printing.

2. A stencil holder as defined in claim 1, wherein:

a separate guide means is provided for each tensioning element.

3. A stencil holder as defined in claim 1, wherein:

the guide means guides the tensioning element for movement exclusively in a tension force direction.

4. A stencil holder as defined in claim 1, wherein:

the guide means have guide members movable in the tension force direction in guide member receiving means.

5. A stencil holder as defined in claim 4, wherein:

the guide member receiving means of one row are arranged in one common guide rail.

6. A stencil holder as defined in claim 4, wherein:

the guide members directly support the tensioning elements.

7. A stencil holder as defined in claim 6, wherein:

each guide member is guided in the direction of the tension force direction on both sides of the tensioning element arranged thereon.

8. A stencil holder as defined in claim 1, wherein:

the tensioning elements associated with several guide means are acted upon with a single source of tension force.

9. A stencil holder as defined in claim 8, wherein:

the source of tension force comprises a pressure element variable in volume by means of a medium subject to pressure.

10. A stencil holder as defined in claim 9, wherein:

the variable-volume pressure element has a container comprising a flexible material for the medium subject to pressure.

11. A stencil holder as defined in claim 9, wherein:

all the tensioning elements of one row are acted upon by a single source of tension force, and each of the guide means is thereby movable independently of the other guide means substantially in the tensioning direction.

12. A stencil holder as defined in claim 11, wherein:

the source of tension force extends along the respective row of tensioning elements and, with it, different tensioning distances are generated in different sections in longitudinal direction.

13. A stencil holder as defined in claim 10, wherein:

the pressure element comprises a pressure hose.

14. A stencil holder as defined in claim 1, wherein:

a separate source of tension force is associated with each guide means.

15. A stencil holder as defined in claim 14, wherein:

the number of sources of tension force corresponds to the number of tensioning elements.

16. A stencil holder for stencils, comprising:

a stencil made of metal film and having rows of fixing elements, a frame having four frame supports, at least two rows of tensioning elements acting on corresponding rows of said fixing elements by means of a positive connection with said fixing elements for removably fixing said stencil, said rows being arranged on the frame and located opposite one another, said tensioning elements of at least one of said rows being movable in a first tensioning direction extending transversely to the rows for tensioning the stencil, a plurality of cylinders for moving said tensioning elements of the movable row in the tensioning direction, at least one tensioning element being associated with each cylinder and movable independently of the respectively other tensioning elements, each cylinder having a piston mounted for displacement in a cylinder chamber, and a common guide rail arranged on said frame, wherein the cylinder chambers for the cylinders for each row of tensioning elements are arranged in said common guide rail extending along the respective row.

17. A stencil holder as defined in claim 16, wherein:

the cylinder chambers are arranged in the guide rail with cylinder chamber axes aligned parallel to one another.

18. A stencil holder as defined in claim 17, wherein:

the pistons directly support the tensioning elements.

19. A stencil holder as defined in claim 18, wherein:

the pistons and the tensioning elements are guided in common guide means.

20. A stencil holder as defined in claim 19, wherein:

the pistons are guided on both sides of the tensioning elements in the direction of the cylinder chamber axes.

21. A stencil holder as defined in claim 19, further comprising:

a source of tension force comprises an elastic biasing means for acting upon the tensioning elements.

22. A stencil holder as defined in claim 19, further comprising:

a tension release element, wherein:

the tensioning elements are movable with said tension release element contrary to the action of the sources of tension force into a position freeing the stencil.

23. A stencil holder as defined in claim 22, wherein:

the tension release element comprises an element variable in volume by means of a medium subject to pressure.

24. A stencil holder as defined in claim 22, wherein:

each tensioning element comprises an entrainment means engaging in one of said fixing elements, and each entrainment means is designed as a recess in the stencil.

25. A stencil holder as defined in claim 16, wherein:

the cylinder chambers of a row of tensioning elements are supplied with an actuating medium by a common supply channel.

26. A stencil holder as defined in claim 16, wherein:

the cylinder chambers are designed as cylinder chamber bores in the guide rail.

27. A stencil holder as defined in claim 16, wherein:

the respective guide rail forms one of the frame supports arranged on the corresponding side of the frame.

28. A stencil holder as defined in claim 16, further comprising:

an abutment surface arranged on the frame, wherein the stencil is provided with edge strips and is placeable on said surface with its respective edge strips for tensioning.

29. A stencil holder as defined in claim 28, wherein:

the tensioning elements act on the fixing element with a tension force drawing the stencil against the abutment surface.

30. A stencil holder as defined in claim 29, wherein:

the tension force acts in a tension force direction forming an acute angle with a stencil plane of the stencil.

31. A stencil holder as defined in claim 30, wherein:

the tensioning elements are movable in a direction forming an acute angle with the stencil plane.

32. A stencil holder as defined in claim 16, wherein:

two rows of tensioning elements located opposite one another are arranged on said frame for tensioning in a second tensioning direction.

33. A stencil holder as defined in claim 32, wherein:

both rows of tensioning elements are guided by guide means for movement in the second tensioning direction.

34. A stencil holder as defined in claim 16, wherein:

all of the cylinders of one of the rows are acting with essentially the same tensioning force on the tensioning elements associated therewith.

* * * * *